US006122937A

United States Patent [19]

Roell

[11] Patent Number: 6,122,937

[45] Date of Patent: Sep. 26, 2000

[54] PROCESS FOR PRODUCING THREE-DIMENSIONAL KNITTED FABRICS AND TEXTILE MATERIAL THUS PRODUCED

[75] Inventor: Friedrich Roell, Biberach, Germany

[73] Assignee: Recaro GmbH & Co., Kirchheim-Teck, Germany

[21] Appl. No.: 09/171,370

[22] PCT Filed: Apr. 18, 1997

[86] PCT No.: PCT/DE97/00792

§ 371 Date: Mar. 22, 1999

§ 102(e) Date: Mar. 22, 1999

[87] PCT Pub. No.: WO97/40221

PCT Pub. Date: Oct. 30, 1997

[30] Foreign Application Priority Data

Apr. 18, 1996 [DE] Germany ..... 196 16 005

[51] Int. Cl.[7] ..... D04B 7/10

[52] U.S. Cl. ..... 66/70; 66/76

[58] Field of Search ..... 66/64, 70, 71, 66/73, 76, 77, 61, 75.1

[56] References Cited

FOREIGN PATENT DOCUMENTS

| | | | |
|---|---|---|---|
| 631470 | 12/1927 | France | 66/200 |
| 562751 | 10/1932 | Germany | 66/200 |
| 3937406 | 5/1991 | Germany | 66/200 |
| 469998 | 8/1937 | United Kingdom | 66/200 |
| 2206609 | 1/1989 | United Kingdom | 66/200 |

*Primary Examiner*—Danny Worrell
*Attorney, Agent, or Firm*—Smith-Hill and Bedell

[57] ABSTRACT

The present invention relates to a method of producing a three-dimensional knit, i.e. a knit whose area is shaped spatially. In accordance with the invention a homogeneously tough three-dimensional knit structure is achieved when loops in specific portions are widened and/or narrowed, this widening/narrowing of the loops being done at many locations arranged distributed homogeneously over the area to be formed three-dimensionally. In the same way a three-dimensional knit may be produced in which the knitting needles are inactivated at least in part over at least one course in the portion to be shaped and later reactivated whilst in the other portions full knitting is continued.

10 Claims, 1 Drawing Sheet

PROCESS FOR PRODUCING THREE-DIMENSIONAL KNITTED FABRICS AND TEXTILE MATERIAL THUS PRODUCED

The invention relates to a method of producing a three-dimensional knit, i.e. a knit whose surface area is shaped spatially, as is the case of e.g. balaclava helmets or sock heels, shaping being achieved by accepted practice in loops being widened and/or narrowed in specific portions of the knit.

It is in the marginal portion of such widening or narrowing that inhomogeneities materialize due especially to the normal, i.e. not knitted three-dimensionally, knit being tensioned or deformed in the marginal portion of the three-dimensionally knitted area. Accordingly, these marginal portions represent a weakened zone having the tendency to open up when exposed to mechanical stress.

It is thus the object of the present invention to provide a three-dimensional knit which is relatively insensitive all over to mechanical stresses.

In accordance with the invention widening or narrowing the loops is no longer done in a single defined portion, but at many locations preferably distributed homogeneously in the shaping area. In this way shaping is integrated homogeneously in the knit, i.e. excessively stressed margins no longer occur in the marginal portion of a closely defined shaping area which tend to break prematurely.

The art in accordance with the invention permits production of all possible shapes such as e.g. spherical or dished shapes without e.g. as in the conventional fashioning technique a line existing within which all loops are reduced, resulting in the knit being subjected to particular stresses in the region of this line. Due to the invention, widening or narrowing or inactivating needles is distributed over the complete portion to be shaped so that the deformation of the knit no longer occurs along a line, it instead being homogeneously distributed over the complete knit. Furthermore, the deformation at each and every widening or narrowing location or needle inactivating/activating is no longer so pronounced since due to the plurality of locations widening/narrowing/inactivation becomes less at each location, i.e. the deformation of the knit at any widening/narrowing/inactivation location is less than in prior art in which all widening/narrowing/inactivation needed for shaping was done at only a single or a few locations.

These locations as cited above are now homogeneously distributed by the invention over the portion to be shaped, this distribution being intended to be as even, i.e. homogeneous as possible. The distribution may be achieved regularly, i.e. controlled so that all widening/narrowing/inactivation locations are spaced away from each other more or less evenly. However, these locations may also be distributed statistically over the portion to be shaped, thus avoiding the creation of all and any texture possibly consistituing a design break point.

The degree of deformation is preferably controlled via the density, i.e. the mutual spacing of the locations where widening/narrowing/inactivation occurs. Should heavy deformation be desired, then these locations are arranged in a higher density than in portions in which less deformation is wanted. In this way homogeneous textile pieces may be produced comprising portions less and more deformed as desired, thus enabling homogeneous knits to be produced in any desired shape.

A basic distinction is made between two ways of producing three-dimensional textile structures. For one, a three-dimensional shape is achieved by widening and/or narrowing the loops in several portions of the knit, whereby the number of widened/narrowed or split/unified loops per location should not be excessive, e.g. not amount to more than ten loops. Widening several loops within the knit at several locations produces a bulge in the knit at the widening locations. Narrowing the loops in the knit at a plurality of locations causes the knit to pucker in this portion, again producing a bulged portion. Widening and narrowing may be combined as desired to achieve the desired shapes.

Another way of producing three-dimensional knits consists of rendering needles inactive in specific portions of the knit whilst knitting is continued with the needles in other portions. By later activating these inactivated needles, e.g. after one or more courses a puckering of the knit in this inactivated portion is achieved which in turn may be made use of to achieve specific shapes. When, for instance, in knitting the needles are made inactive in the marginal portions of the flat knitting machine, and this inactivation repeated on a spacing of a few courses differing in width, a spherical configuration is achieved having a highly homogeneous structure. In this case too, inactivating the needles should be done only over a few courses to avoid excessively deforming the knit at any one location. Furthermore, the width (needle number) of inactivating may be alternatingly varied so that also by these means a distribution of the deformed locations may be achieved in the shaping portion, these locations being positioned at point s at which an inactivated portion adjoins a fully knitted portion.

Both of the principles as cited above for producing geometric knits may be put to use with the method in accordance with the invention in that widening/narrowing the loops, on the one hand, or inactivating needles, on the other, is distributed to many locations in the shaping portion. In any case, a more homogeneous structure of the three-dimensional knit is achieved, on the one hand, which in turn has enhanced mechanical properties.

A distributed widening/narrowing of the loops within the knit may be achieved to advantage by using twin needles. For example, an alternating knit may be done with the A and B needles of the twin needles, resulting in a loop count corresponding to twice the number of active twin needles or conventional needles. When a reduction in the loop count is desired, knitting is continued only with one of the A or B needles of the twin needle. This results in the loop count being reduced to half for the same width of the active portion of the needle bed. This reduction may also be achieved in other steps when the reduction to one of the two needles of the twin needle is not implemented for every twin needle but e.g. only to ever second such needle. Likewise, an increase in the loop count may be achieved by changing from knitting with one of the two needles of the twin needle to knitting with both needles, the two needles of the twin needle then being activated successively.

The invention will now be described by way of an example as illustrated schematically in the drawing in which.

Figure 1:
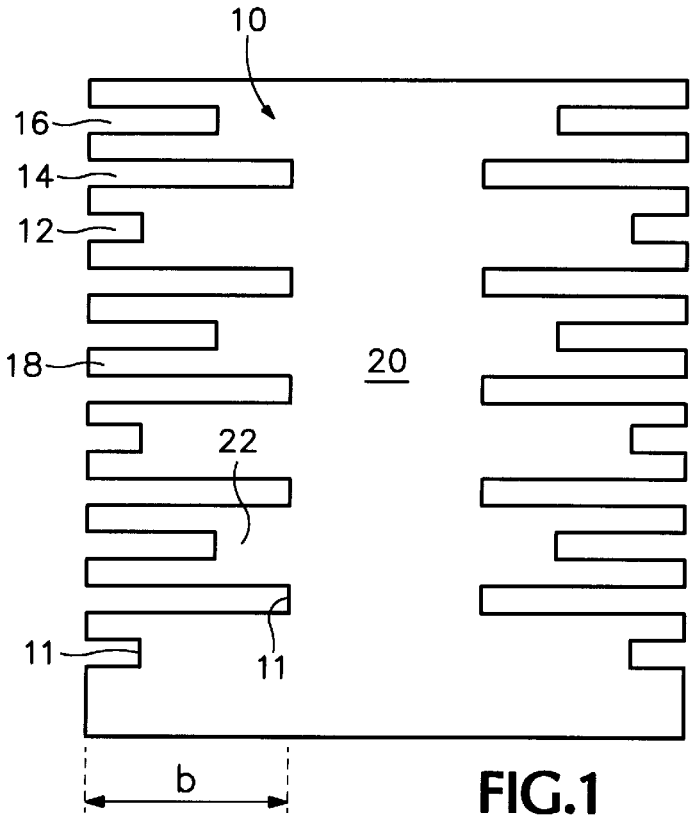
FIG. 1 is a construction for knitting a spherical knit by inactivating needles in the marginal portion of the knit.

Referring now to FIG. 1 there is illustrated a construction for producing a roughly spherical knit, the actual knitted textile area 10 being evident from this Figure. Shaping the textile is achieved by inactivating needles partially or completely within a portion b on both sides of the textile area 10 so that in this portion knitting is not done over one or more needle rows. In subsequent reactivation of the needles the loops are then joined to the loops last knitted, i.e. specific portions of the courses are simply missing during the time in which activation of the needles in the marginal portion b of the knit 10 is lacking. Accordingly, the courses before and after the missing portion are simply knitted together, as a result of which the knit in this portion is puckered corresponding to the number of non-knitted courses. The points at which a deformation occurs in this arrangement are the points 11. At these points 11 the inactivated portions adjoin the fully knitted portions, this being the reason why preferably the width of the inactivated portion, i.e. the number of inactivated needles is continuously varied so that also the deformation points 11 are homogeneously distributed within the shaping portion b. In this way a defined structuring of the reduction is avoided which in turn would involve a weakening of the knit. The mutual spacing of the inactivations 12, 14, 16 is relatively constant so that the deformation points 11 exhibit a more or less homogeneous spacing also in the interlooping direction.

In the construction as shown in FIG. 1 the needles are inactivated in a first short portion 12, covering for example only 20 needles. In a later portion, i.e. a couple of courses further, the loops are inactivated in a portion 14 extending over the full width b of the shaped portion. Inactivation in this case would involve e.g. 60 needles. Again a couple of courses later, the needles are activated over a width 13 located between the two widths as cited above, e.g. for 40 needles. The deformation points 11 are thus homogeneously distributed over the deformation width b. The inactivated portions 12, 14, 16 are always alternated with fully knitted portions 18 in which the knit is produced over the full width, resulting in more or less equispacing of the points 21 in the interlooping direction. Running through the middle of the knit 10 is a portion 20 which is fully knitted, whilst furthermore outwards a portion 22 extends in which the knit already comprises non-knitted courses at a spacing of several courses. These non-knitted portions widen in the outward direction as is easily appreciated from the drawing. When now envisaging the knitted portions 18 being joined to each other at their top and bottom edges, it will readily be appreciated that the knit as illustrated in FIG. 1 is roughly spherical in shape. Each inactivation 12, 14, 16 runs in the knit over two courses in sequence. It is, of course, just as possible to directly attach various inactivated portions 12, 14, 16 to each other without any fully knitted portions inbetween in wanting to achieve stronger shaping. The degree of shaping is set by the spacing, i.e. the sequence of the inactivations and the width of the inactivation portions 12, 14, 16. Thus, the wider the inactivation portions and inactivation sequence, the stronger is also the shaping.

Figure 2:
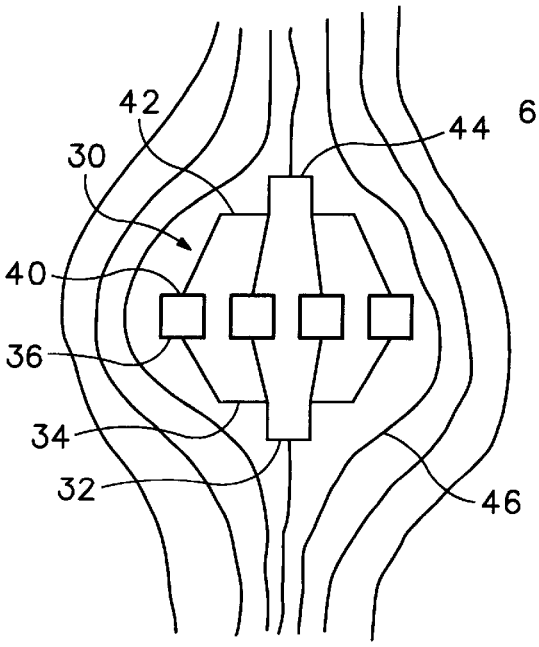
FIG. 2 is an illustration of a bulged portion achieved by widening and narrowing loops in one portion.
Figure 3:
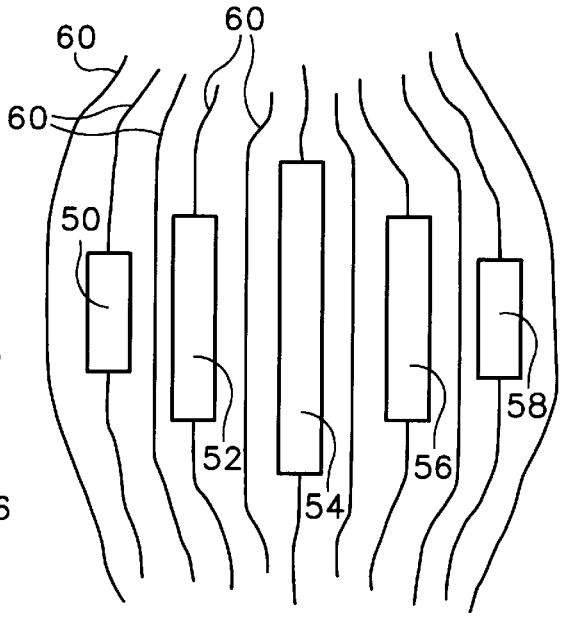
FIG. 3 is a construction of a bulged portion achieved by widening and narrowing loops in accordance with the invention.

Whilst FIG. 1 illustrates a method for producing three-dimensional knit structures by inactivating needles, FIGS. 2 and 3 show a knitting method in which a three-dimensional shape is produced by widening or narrowing the loops. FIG. 2 illustrates a method in which three-dimensionally shaping the knit is done in a defined portion 30 where, namely, in a first stage 32 a loop is doubled, the loop being split into two loops so that instead of a single wale two wales now exist. At the location 34 the two wales are again split into two wales each so that now four wales exist which at the location 36 are yet again split up into eight wales. It is at this location that the portion 30 is widest. At the location 40 two loops each are puckered into a single loop, i.e. reduced, as a result of which after the location 40 only four wales exist. At the locations 42 and 44 a further reduction is made so that in the end only a single wale is again present. In the portion 46 about the three-dimensionally shaped portion 30 the knit is subjected to an increased mechanical stress due to the deformation in this marginal portion. This deformation involves premature fatigue, wear and tear of the material or greater susceptibility to mechanical stressing.

To get round this disadvantage the widening in accordance with the invention is not done in a portion 30, as shown in FIG. 2, but at five different locations 50, 52, 54, 56, 58 at each of which a loop is split up into two loops and subsequently recombined into a single loop. The splitting duration for the five locations differs, so that a homogeneous distribution of the widening/narrowing locations within the knit exists. Furthermore, between the widening/narrowing location 50, 52, 54, 56, 58 fully knitted wales 60 are arranged serving to enhance the homogenity of the knit throughout the complete shaped portion.

It will readily be appreciated from comparing the prior art knit method to the new knit method that shaping the knit is substantially more homogeneous than in prior art and that such a knit is very much more resistant to mechanical stresses and premature material fatigue. In addition to this, the geometry of the three-dimensionally shaped portion may be better controlled by the invention, i.e. via the spacing of the locations 50, 52, 54, 56, 58 and via the widening/narrowing length at each single location 50, 52, 54, 56, 58. In the present example, the longest widening is undertaken in the middle portion, i.e. the portion most bulged, whereas in the adjoining locations 52, 56 the widening is not so long and in the marginal locations 50, 58 the widening is only relatively short, here, for instance, the widening/splitting extending over one to ten courses.

The present invention is thus suitable for producing all possible geometric shapes such as spheres, cones and all kinds of regularly and irregularly shaped bulges. Both widening/narrowing the loops and partially inactivating the needles in a course may be done in an unequal spacing and to a differing extent. It may furthermore be done controlled or statistically to achieve as high a homogenity as possible. Care is to be taken, however, in the distribution of these locations and in the distribution of the extent of widening/narrowing/inactivation so that, in all, a more or less consistent shaping of the knit is achieved over the full area.

The two basic techniques of widening/narrowing, on the one hand, and fashioning, on the other, may, of course be optionally combined with each other.

What is claimed is:

1. A method of producing a knit by creating loops, said method comprising:

(a) knitting a first portion of the knit by creating loops, (b) knitting a second portion of the knit by creating widening or narrowing loops at a first plurality of deformation regions, the deformation regions of said first plurality being distributed over the second portion of the knit with a substantially uniform density, and (c) knitting a third portion of the knit by creating widening or narrowing loops at a second plurality of deformation regions, the deformation regions of said second plurality being distributed over the third portion of the knit with a substantially uniform density, wherein the density of deformation regions in the third portion of the knit is different from the density of deformation regions in the second portion of the knit and wherein each deformation region has a width no greater than ten loops.

2. A method according to claim 1, wherein step (b) comprises creating widening loops in first and second wales, whereby the first and second wales are split and form, respectively, a first pair of wales and a second pair of wales, and subsequently creating narrowing loops which recombine the first pair of wales and the second pair of wales respectively, there being a fully knitted wale between the first pair of wales and the second pair of wales.

3. A method according to claim 1, employing twin needles for knitting and selecting a first number of active needles for each twin needle in step (a) and a second number of active needles for each twin needle in step (b), and wherein the first number is different from the second number.

4. A method according to claim 1, employing a flat knitting machine with twin needles, wherein both needles of the twin needle are used for knitting in step (b) and only one needle of the twin needle is used for knitting in step (a).

5. A method according to claim 1, wherein step (b) comprises creating widening loops and subsequently creating narrowing loops.

6. A method of producing a knit having a multiplicity of courses employing a knitting machine having a plurality of needles each of which can be deactivated and reactivated, said method comprising, (a) knitting a first portion of the knit with all the needles in the active state, (b) knitting a second portion of the knit with selected needles in the inactive state over at least one course, and (c) knitting a third portion of the knit with all the needles in the active state, and wherein step (b) includes deactivating the selected needles and subsequently reactivating the selected needles and wherein deactivating and reactivating of the selected needles in the second portion of the knit is effected at a plurality of points that are distributed over the second portion of the knit and are substantially equispaced with respect to the courses of the knit.

7. A method according to claim 6, wherein in step (b) the selected needles remain in the inactive state over up to thirty courses.

8. A method according to claim 6, wherein step (b) includes repeatedly deactivating and subsequently reactivating the selected needles and wherein in each repetition the selected needles remain inactive over from one to thirty courses.

9. A method according to claim 8, wherein on successive repetitions, the number of needles that remain inactive varies.

10. A method of producing a knit having a multiplicity of courses employing a knitting machine having a plurality of needles each of which can be deactivated and reactivated, said method comprising:

(a) knitting a first portion of the knit by creating loops, (b) knitting a second portion of the knit by creating widening or narrowing loops at a first plurality of deformation regions, the deformation regions of said first plurality being distributed over the second portion of the knit with a substantially uniform density, and (c) knitting a third portion of the knit by creating widening or narrowing loops at a second plurality of deformation regions, the deformation regions of the second plurality being distributed over the third portion of the knit with a substantially uniform density, wherein the density of deformation regions in the third portion of the knit is different from the density of deformation regions in the second portion of the knit and wherein each deformation region has a width no greater than ten loops, and (d) knitting a fourth portion of the knit with all the needles in the active state, (e) knitting a fifth portion of the knit with selected needles in the inactive state over at least one course, and (f) knitting a sixth portion of the knit with all the needles in the active state, and wherein step (e) includes deactivating the selected needles and subsequently reactivating the selected needles and wherein deactivating and reactivating of the selected needles in the fifth portion of the knit is effected at a plurality of points that are distributed over the fifth portion of the knit and are substantially equispaced with respect to the courses of the knit.

* * * * *